US009995062B2

(12) United States Patent
Yun

(10) Patent No.: US 9,995,062 B2
(45) Date of Patent: Jun. 12, 2018

(54) DEVICE FOR RELEASING CATCHER FOR REFRIGERATOR AND FREEZER

(71) Applicant: KONG JIN CO., LTD, Gunpo (KR)

(72) Inventor: Kyu Jung Yun, Seongnam (KR)

(73) Assignee: KONG JIN CO., LTD, Gunpo-si (KR)

( * ) Notice: Subject to any disclaimer, the term of this patent is extended or adjusted under 35 U.S.C. 154(b) by 403 days.

(21) Appl. No.: 14/434,900

(22) PCT Filed: Feb. 11, 2014

(86) PCT No.: PCT/KR2014/001130
§ 371 (c)(1),
(2) Date: Apr. 10, 2015

(87) PCT Pub. No.: WO2014/185621
PCT Pub. Date: Nov. 20, 2014

(65) Prior Publication Data

US 2016/0053510 A1 Feb. 25, 2016

(30) Foreign Application Priority Data

May 16, 2013 (KR) ..... 10-2013-0055870

(51) Int. Cl.
*E05B 15/02* (2006.01)
*E05B 63/24* (2006.01)
(Continued)

(52) U.S. Cl.
CPC ..... *E05B 63/246* (2013.01); *E05B 15/022* (2013.01); *E05B 15/0245* (2013.01);
(Continued)

(58) Field of Classification Search
CPC ..... Y10T 292/0911; Y10T 292/0926; Y10T 292/0928; Y10T 292/0932;
(Continued)

(56) References Cited

U.S. PATENT DOCUMENTS 2,089,163 A * 8/1937 Hansen ..... E05B 15/025 292/341.18
2,461,426 A * 2/1949 King ..... E05B 63/246 292/DIG. 65
(Continued)

FOREIGN PATENT DOCUMENTS

GB 720764 A * 12/1954 ..... E05B 63/246
JP H0735975 7/1995
(Continued)

*Primary Examiner* — Alyson M Merlino
(74) *Attorney, Agent, or Firm* — Lex IP Meister, PLLC

(57) ABSTRACT

The present invention relates to a catcher release device for a refrigerator and freezer, and more particularly, to a catcher release device for a refrigerator and freezer that has releasing means disposed on the inside of a side panel on which a catcher is located in such a manner as to be connected to the catcher, so that if a person is locked in the refrigerator and freezer, an inner handle of the releasing means just rotates, irrespective of a door lock device, thus allowing the catcher to be separated from the door lock device to rapidly open a door for the refrigerator and freezer.

9 Claims, 6 Drawing Sheets

(51) Int. Cl.
*F25D 23/02* (2006.01)
*E05B 65/00* (2006.01)
*F25D 29/00* (2006.01)

(52) U.S. Cl.
CPC ..... *E05B 65/0053* (2013.01); *F25D 23/028* (2013.01); *F25D 29/006* (2013.01)

(58) Field of Classification Search
CPC ..... Y10T 292/0945; Y10T 292/0946; Y10T 292/0949; Y10T 292/0956; Y10T 292/1043; Y10T 292/1051; Y10T 292/1052; Y10T 292/1054; Y10T 292/1055; Y10T 292/0936; Y10T 292/1062; Y10T 292/1075; Y10T 292/1076; Y10T 292/108; Y10T 292/1087; Y10T 292/1095; Y10T 292/68; Y10T 292/696; Y10T 292/702; Y10S 292/65; Y10S 292/71; E05B 15/025; E05B 15/022; E05B 63/246; E05B 65/0042; E05B 65/0058; E05B 15/0245; E05B 65/0053; F25D 23/028; F25D 29/006
See application file for complete search history.

(56) References Cited

U.S. PATENT DOCUMENTS 2,618,498 A * 11/1952 Schlesser ..... E05B 63/246 292/DIG. 65
2,636,767 A * 4/1953 Groeger ..... E05B 63/246 292/341.18
2,743,953 A * 5/1956 Marra ..... E05B 63/246 292/341.18
2,747,906 A * 5/1956 Emmert ..... E05B 63/246 292/341.15
2,762,645 A * 9/1956 Bordner, Jr. ..... E05B 63/246 292/341.17
2,772,110 A * 11/1956 Petrochko ..... E05B 63/246 292/341.17
4,530,532 A * 7/1985 Fujiya ..... E05B 63/246 292/341.15
4,547,008 A * 10/1985 Takasaki ..... E05B 63/246 292/341.15

FOREIGN PATENT DOCUMENTS

KR 20-2000-0008602 5/2000
KR 20-0206895 10/2000
KR 20-2010-0012567 12/2010
KR 101464359 B1 * 11/2014 ..... E05B 63/246

* cited by examiner

[FIG. 1]
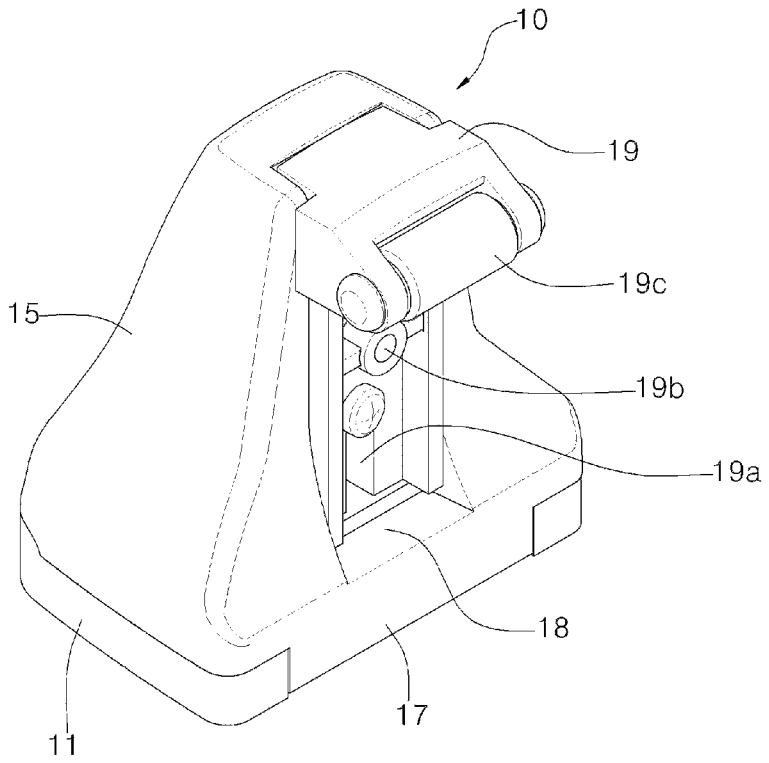

[FIG. 2]
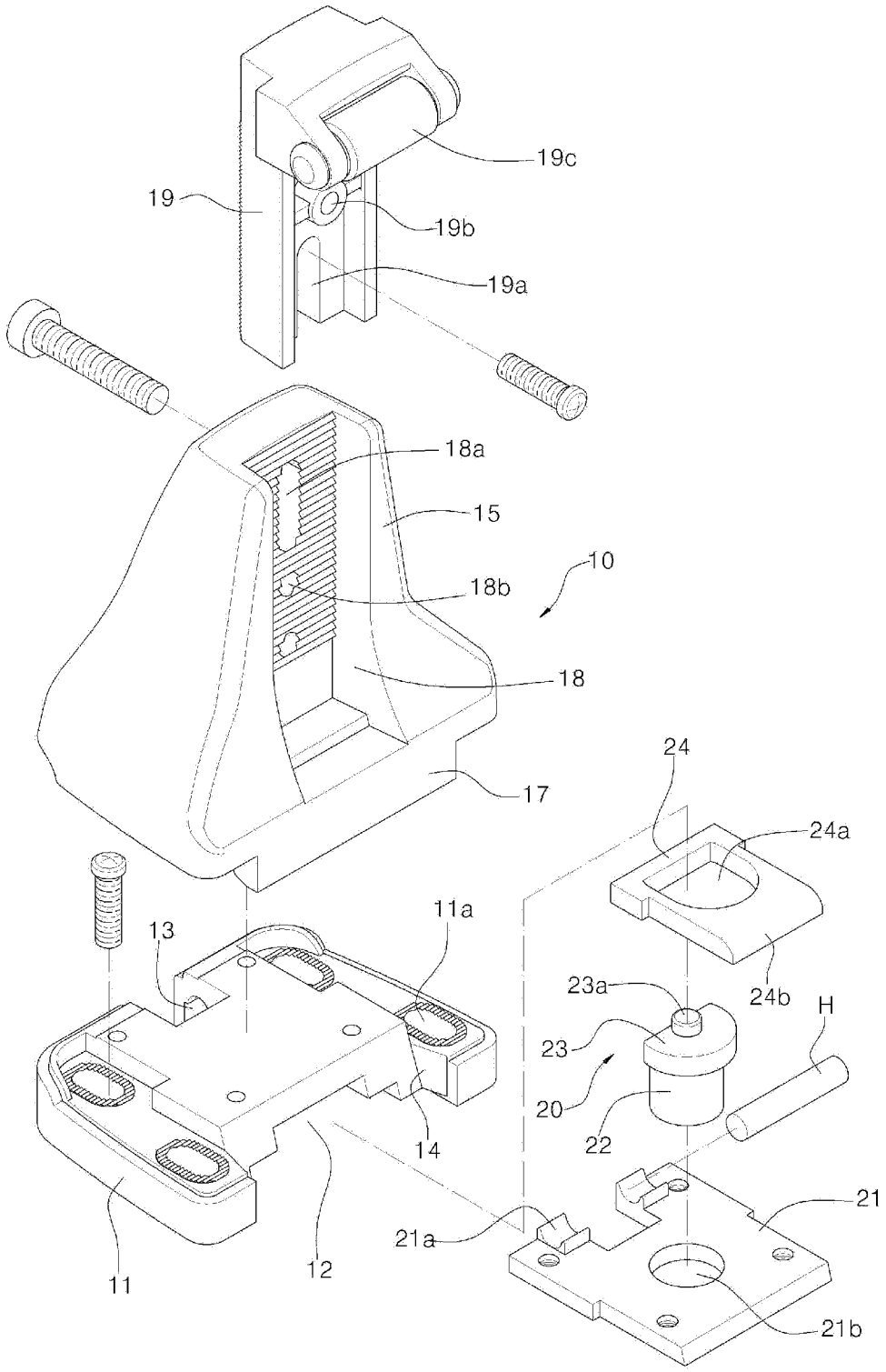

[FIG. 3]
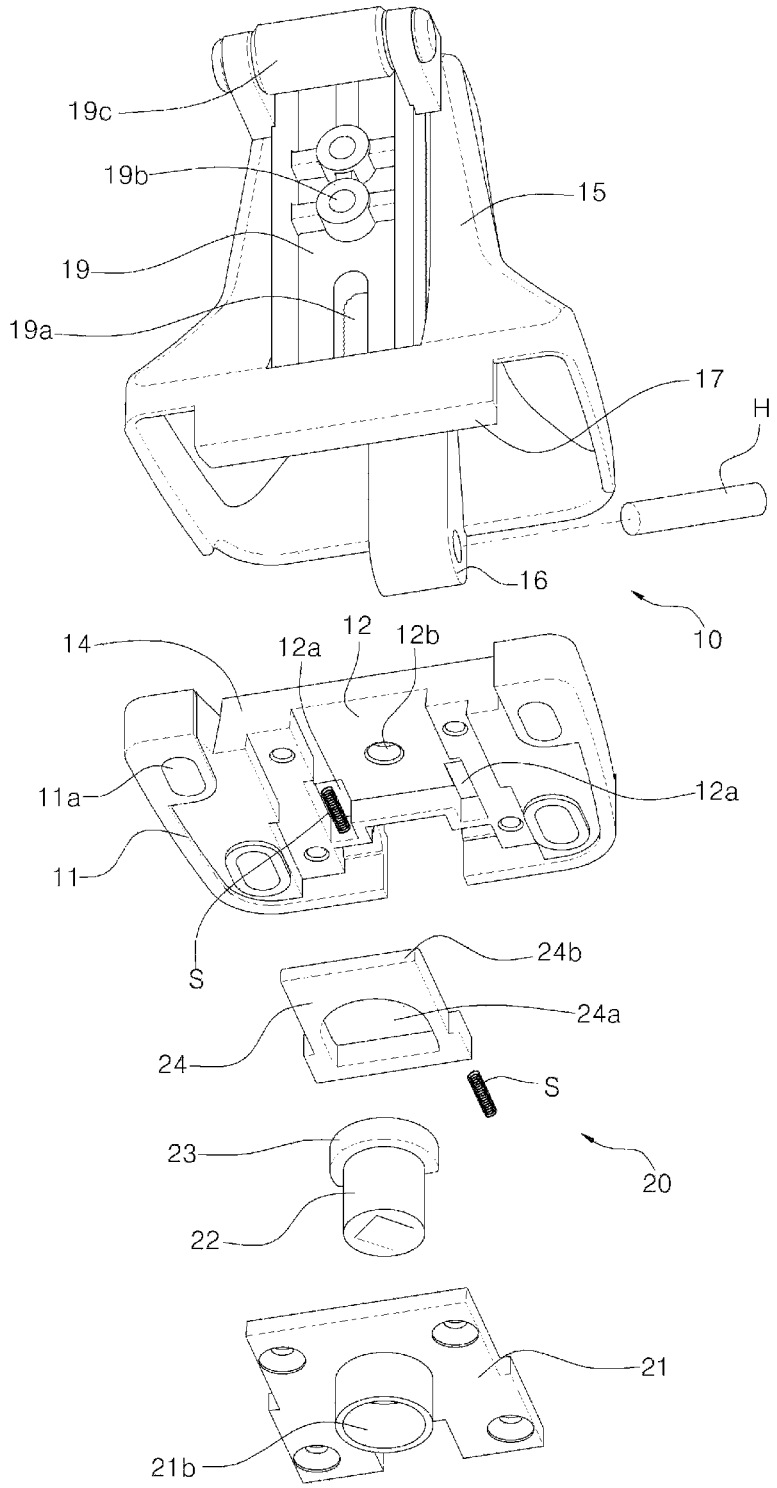

[FIG. 4]
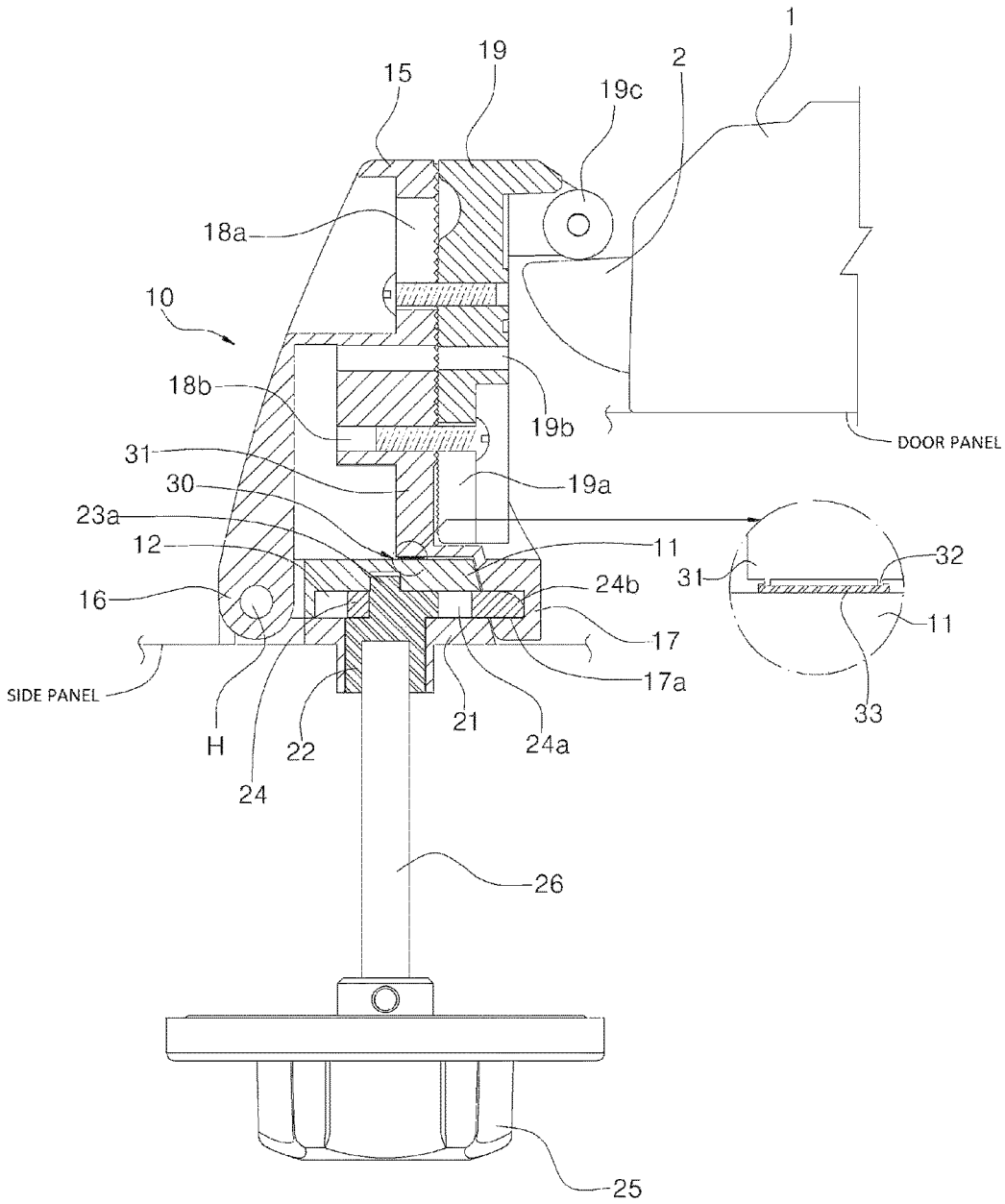

[FIG. 5]
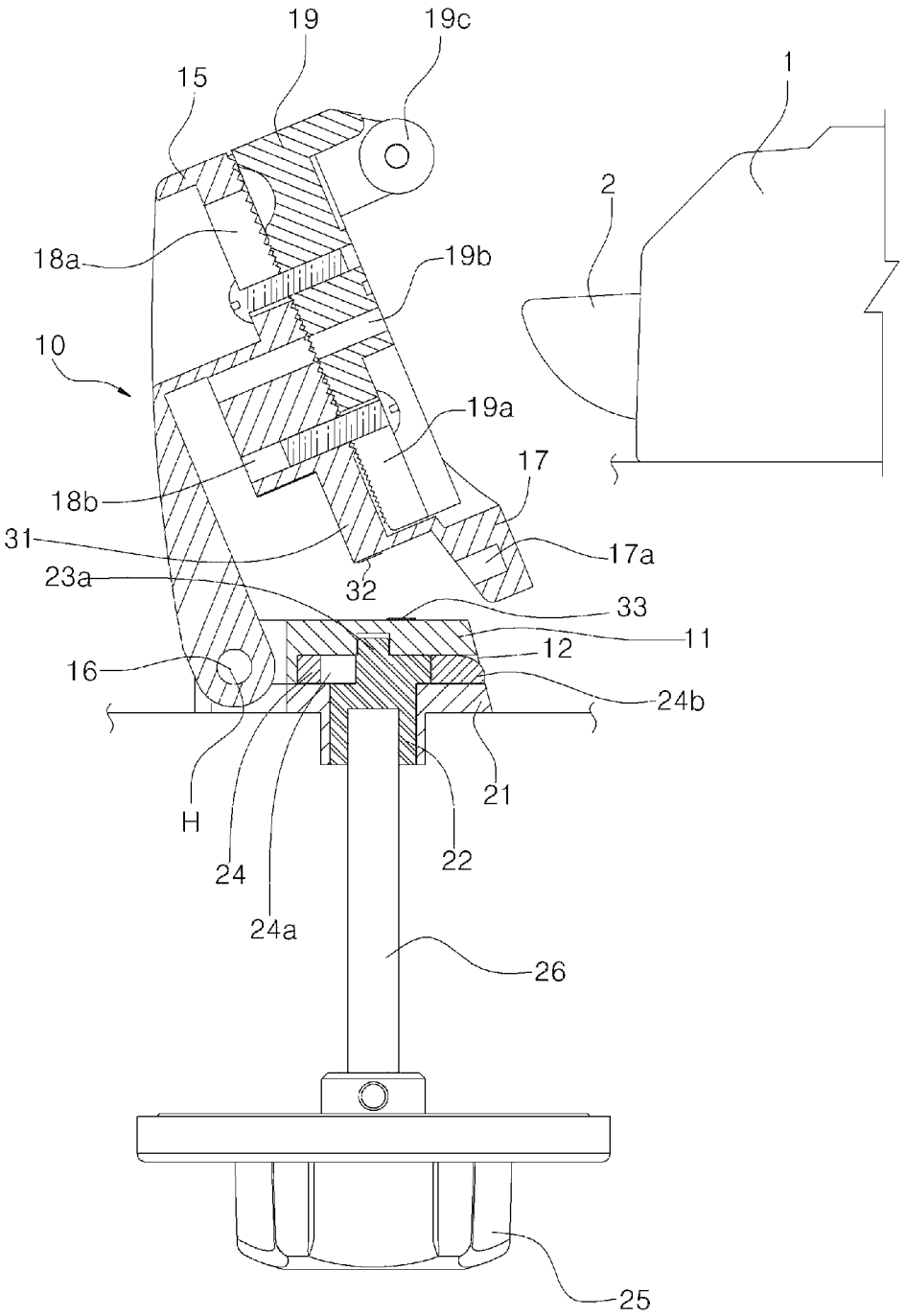

[FIG. 6]
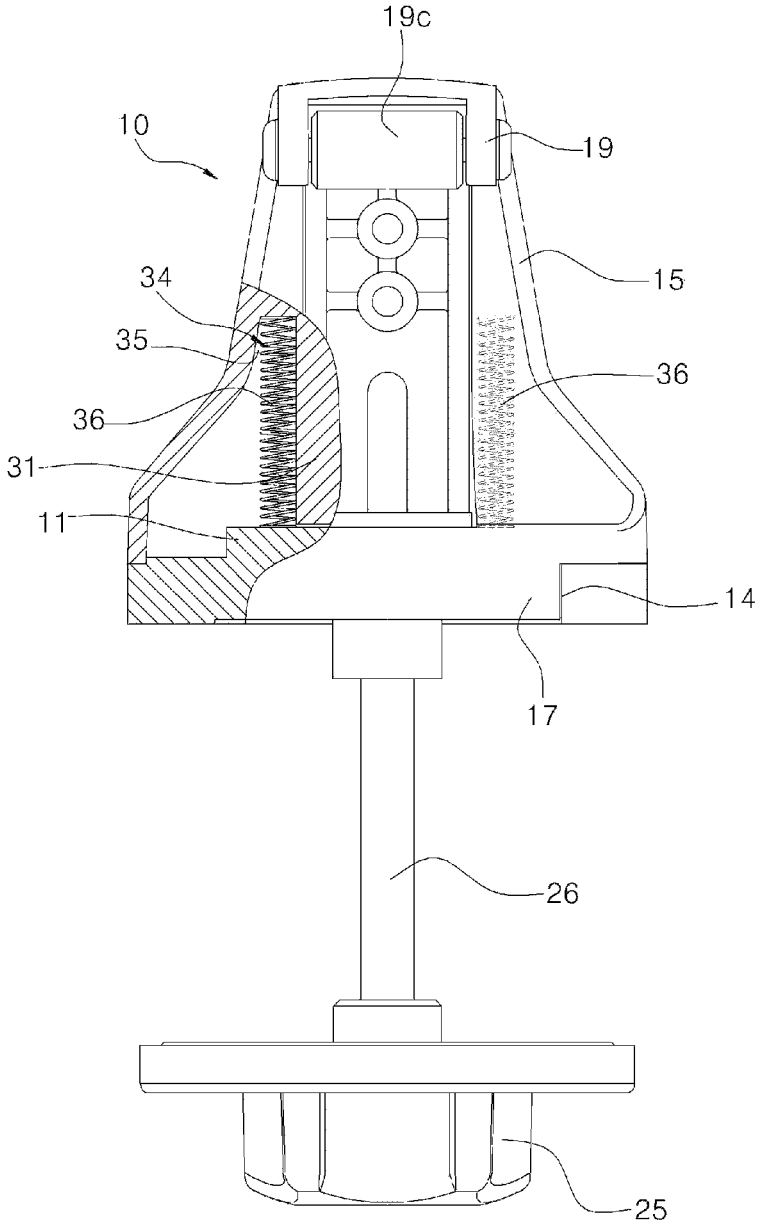

DEVICE FOR RELEASING CATCHER FOR REFRIGERATOR AND FREEZER

BACKGROUND OF THE INVENTION

Field of the Invention

The present invention relates to a catcher release device for a refrigerator and freezer, and more particularly, to a catcher release device for a refrigerator and freezer that has releasing means disposed on the inside of a side panel on which a catcher is located in such a manner as to be connected to the catcher, so that if a person is locked in the refrigerator and freezer, an inner handle of the releasing means just rotates, irrespective of a door lock device, thus allowing the catcher to be separated from the door lock device to rapidly open a door for the refrigerator and freezer.

Background of the Related Art

Generally, a refrigerator and freezer is used to keep articles to be cooled and frozen therein temporarily or for a long period of time, thus preventing them from being decayed. On the other hand, a door lock device having a case in which a handle and a lock are disposed is mounted on a door panel for the refrigerator and freezer, and a catcher is coupled to a side panel disposed at the opposite side to the door panel, so that a lock of the door lock device is fixed to a striker located at the front surface of the catcher, thus maintaining the locking state of the door.

According to conventional door lock devices, a case is mounted on a door panel, and an operating lever is coupled to a handle connected to the case by means of a pin shaft. Next, one end of the operating lever is connected to a latch, and the latch is supported against an elastic spring in such a manner as to be reciprocated. The case has a frame having fixing holes formed on both sides thereof in such a manner as to fix the case to the door panel by means of bolts or rivets, and a base plate is coupled to the underside of the case by means of bolts.

An example of conventional door lock devices for the door of a refrigerator and freezer is disclosed in Korean Patent No. 10-0321873, wherein the door lock device, which has a lock located on a refrigerator and freezer chamber correspondingly to a striker in such a manner as to be controlled by means of a handle, includes: a catcher located at a given accommodation space and having an accommodation portion formed by a bending portion shielding a support plate on which the striker is disposed; opening and closing means having an outer handle adapted to adjust a quantity of motion of a finger rotating by a given range at the inside and outside of the refrigerator and freezer chamber in such a manner as to correspond to the striker, the opening and closing means being adapted to induce the linear reciprocating motion of an operating plate through the rotation of a trigger connected to an inner handle at the opposing position to the outer handle; releasing means having the inner handle disposed at the inside of the refrigerator and freezer chamber in such a manner as to be not under the influence of the locking state of the outer handle and having a rotary shaft fitted thereto to connect the trigger thereto and the operating plate corresponding to the trigger in such a manner as to be brought into close contact with a base plate; and locking means disposed in a lock box in which the opening and closing means is accommodated in such a manner as to fix the outer handle thereto. According to the conventional door lock device for the door of the refrigerator and freezer, if a person is locked in the refrigerator and freezer, the inner handle rotates to allow the operating plate and the latch to be linearly reciprocated by means of the rotation of the rotary shaft and the trigger, so that the finger connected to the latch is escaped from the striker to open the door. In this case, however, the releasing means becomes complicated in a coupling structure, and it is hard to perform the assembling and separating processes thereof, thus undesirably lowering the productivity thereof.

Since the conventional catcher is maintained at the rigidly fixed state to the side panel, the inner handle and the rotary shaft cannot rotate, thus making it impossible to open the door.

The conventional releasing means becomes complicated in the continuously operating configuration through the organic coupling among the trigger, the operating plate, the latch and the finger upon the operation of the inner handle and the rotary shaft, and further, since the releasing means connected to the conventional door lock device has high price, it may be often removed from the door lock device. If the inner handle of the releasing means is removed from the door lock device, the person may be locked in the refrigerator and freezer. Furthermore, the conventional door lock device and the catcher have many difficulties in the whole assembling processes and the maintenance, thus undesirably increasing the cost of the product and the maintenance cost thereof.

The conventional door lock device and the catcher have main problems as follows: firstly, a hinge shaft of the outer handle may be broken in the process of forcibly pulling the outer handle in the state where a user does not recognize the locking state of the outer handle, thus making it hard to operating the latch and failing to rotate the inner handle; and secondly, if a person is locked in the refrigerator and freezer, he or she cannot be escaped therefrom.

An example of conventional catchers for a door of a refrigerator and freezer is disclosed in Korean Utility Model Laid-Open No. 20-2010-0012567, wherein the catcher includes: a body having an insertion groove formed to accommodate one end portion of a door lock thereinto, a striker mounting portion protruding unitarily from the inside of the insertion groove and having a first fastening hole formed on the side surface thereof, and a base surface having a second fastening hole formed thereon; and a striker having a third fastening hole fastened by means of a bolt to the first fastening hole of the striker mounting portion and having a locking projection formed on the front end portion thereof in such a manner as to be locked onto and released from the door lock. The conventional catcher is just fixed to the side panel, but it does not have any separate releasing means, thus being not expanded in the available range thereof. Further, the conventional catcher is not applied to both of the structure wherein the latch is linearly reciprocated to rotate the finger by the operation of the outer handle and the structure wherein the lock of the latch is linearly reciprocated and escaped from the striker by the operation of the outer handle, so that the conventional catcher should have different structures and coupling systems in accordance with the structures of the door lock device.

SUMMARY OF THE INVENTION

Accordingly, the present invention has been made in view of the above-mentioned problems occurring in the prior art, and it is an object of the present invention to provide a catcher release device for a refrigerator and freezer that has a coupling structure of a housing of a catcher wherein a base frame fixed by means of bolts to the side panel of the door of the refrigerator and freezer is forcibly not separated from the outside, and that has releasing means disposed on the inside of the side panel in such a manner as to be connected to the base frame, while the base frame and the housing are being coupled to each other by means of a hinge shaft, so that if a person is locked in the refrigerator and freezer, the releasing means is separately operated to allow the housing to rotate backward around the hinge shaft and thus to allow the catcher to be separated from a lock of a door lock device, thus opening a door rapidly.

It is another object of the present invention to provide a catcher release device for a refrigerator and freezer that improves the entire structure of a catcher in such a manner as to be applied to a variety of door lock devices, thus expanding its available range, and that is applied to a conventional door lock device having no releasing means connected thereto when a person is locked in the refrigerator and freezer, thus solving the problems occurring when the person is locked in the refrigerator and freezer.

It is yet another object of the present invention to provide a catcher release device for a refrigerator and freezer that avoids a complicate assembling configuration and organic coupling relations for coupling separate releasing means to a door lock device, thus reducing the cost of the product and the maintenance cost of the product.

It is still another object of the present invention to provide a catcher release device for a refrigerator and freezer that is configured to allow a rotary cam disposed between a base frame and a fixing frame to rotate together with the rotation of an inner handle and a rotary shaft coupled to the inside of a side panel of a door of the refrigerator and freezer and thus to allow a locking member to move backward to rotate a housing fixed to the base frame backward around a hinge shaft, thus opening the door, and that is configured especially to have an elastic member disposed on the interior of the housing and the top portion of the base frame to allow the housing to rapidly rotate around the hinge shaft upon the opening of the door.

To accomplish the above-mentioned objects, according to the present invention, there is provided a catcher release device for a refrigerator and freezer, the catcher release device including: a catcher having a base frame fixed to a side panel of a door of the refrigerator and freezer by means of bolts, a housing adapted to surround the interior of the base frame in such a manner as to prevent the base frame from being forcibly disassembled to the outside and fitting-coupled to the base frame by means of a hinge shaft in such a manner as to rotate backward, and a striker fixed to the front surface of the housing by means of bolts in such a manner as to fix a lock of a door lock device thereto; and releasing means having a fixing frame coupled to the underside surface of the base frame by means of bolts in such a manner as to support the lower end periphery of the hinge shaft thereagainst, a locking member and a rotary cam disposed between the fixing frame and the base frame in such a manner as to allow one end of the locking member to appear and disappear into and from the inside of the housing through the rotation of the rotary cam to fix the housing to the base frame, and an inner handle and a rotary shaft disposed on the inside of the side panel in such a manner as to be coupled to the lower end periphery of the rotary cam, wherein as the rotary cam rotates through the rotation of the inner handle and the rotary shaft, the locking member moves backward to allow the housing fixed to the base frame to be separated from the base frame around the rotary shaft, so that the striker of the housing is separated from the lock of the door lock device to allow a person locked in the refrigerator and freezer to be escaped therefrom.

According to the present invention, preferably, the catcher release device further includes an elastic member disposed on the base frame and the interior of the housing to allow the housing to open rapidly upon the rotation around the hinge shaft by means of the elastic force of the elastic member.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 1 is a perspective view showing the coupled state of a catcher release device for a refrigerator and freezer according to the present invention;

FIG. 2 is a perspective view showing the separated state of the catcher release device according to the present invention;

FIG. 3 is an exploded perspective view showing the bottom surface of the catcher release device according to the present invention;

FIG. 4 is a sectional view showing the coupled state of the catcher release device according to the present invention;

FIG. 5 is a sectional view showing the operating state of the catcher release device according to the present invention; and FIG. 6 is a front view showing the coupled state of a second elastic member in the catcher release device according to the present invention.

DETAILED DESCRIPTION OF THE PREFERRED EMBODIMENTS

Hereinafter, an explanation on a catcher release device for a refrigerator and freezer according to the present invention will be in detail given with reference to the attached drawing.

Referring to FIGS. 1 to 6, a catcher release device for a refrigerator and freezer according to the present invention includes: a catcher 10 having a base frame 11 fixed by means of bolts to a side panel of the refrigerator and freezer, a housing 15 coupled to the top portion of the base frame 11 by means of a hinge shaft H, and a striker 19 fixed to the front surface of the housing 15 by means of bolts; and releasing means 20 having an inner handle 25 and a rotary shaft 26 disposed on the inside of the side panel in such a manner as to be connected to the base frame 11, a rotary cam 22 disposed between the base frame 11 and a fixing frame 21 in such a manner as to rotate together with the rotary shaft 26, a locking member 24 adapted to appear and disappear in accordance with the rotation of the rotary cam 22 in such a manner as to allow the housing 15 to move backward around the hinge shaft H and to allow the striker 19 of the housing 15 to be separated from a lock 2 of a door lock device 1, thus opening a door.

The catcher 10 is disposed correspondingly to the door lock device 1 fixed to a door panel of the refrigerator and freezer, and so as to mount the catcher 10, first, the underside surface of the base frame 11 comes into close contact with the side panel of the refrigerator and freezer, and next, bolts are coupled to fixing holes 11*a* formed on the top portions of both side surfaces of the base frame 11, thus allowing the base frame 11 to be fixed to the side panel. Further, the catcher 10 has a slide recess 12 formed on the lower end portion of the base frame 11 in such a manner as to insert the locking member 24 as will be discussed later thereinto to allow the locking member 24 to appear and disappear forward and backward, and has spring seating grooves 12*a* formed on both sides of the rear portion of the slide recess 12 in such a manner as to mount springs S adapted to elastically support the rear surface of the locking member 24 thereinto to return the locking member 24 to its original position upon the appearing and disappearing operations of the locking member 24.

Further, the catcher 10 has a fitting groove 12*b* formed at the inside of the slide recess 12 in such a manner as to insert a fitting protrusion 23*a* of the rotary cam 22 as will be discussed later rotatably thereinto, and semicircular hinge top peripheral surface seating portions 13 formed unitarily with both sides of the inside of the rear portion of the base frame 11 in such a manner as to support the top end periphery of the hinge shaft H thereagainst, and the hinge top peripheral surface seating portions 13 are penetratedly bent inward on the center portion thereof in such a manner as to insert a rotary frame 16 as will be discussed later thereinto to allow the rotary frame 16 to be coupled to the base frame 11 by means of the hinge shaft H. Further, the base frame 11 has a seating portion 14 formed on the front portion thereof in such a manner as to be recessed inward, with which a locking flange 17 of the housing 15 as will be discussed later is brought into close contact. Next, the housing 15 is coupled to top portion of the base frame 11 in such a manner as to allow the bolts exposed to the top portion of the base frame 11 to be not seen from the outside, and so as to prevent the base frame 11 from being forcibly disassembled to the outside, particularly, the housing 15 is coupled to surround the interior of the base frame 11, and the base frame 11 and the housing 15 are fitting-coupled to each other by means of the hinge shaft H.

Further, the catcher 10 has the rotary frame 16 protruding downward from the inner bottom end portion of the rear portion of the housing 15 in such a manner as to be inserted into the center portion of the hinge top peripheral surface seating portions 13 and to be fixed to the base frame 11 by means of the hinge shaft H, and the hinge shaft H is not exposed to the outside through the coupling to the fixing frame 21 as will be discussed later. Further, the catcher 10 has the locking flange 17 protruding downward from the front portion thereof in such a manner as to be brought into close contact with the seating portion 14 of the base frame 11, a locking groove 17*a* formed on the inside of the rear surface thereof in such a manner as to insert one end of the locking member 24 thereinto to allow the housing 15 to be maintained at the fixed state to the base frame 11, and an accommodating portion 18 formed on the inside of the front surface thereof in such a manner as to couple the striker 19 thereto by means of bolts.

In this case, the accommodating portion 18 has a first position control hole 18*a* and a plurality of bolt holes 18*b* formed at the inside thereof in such a manner as to allow the striker 19 coupled thereto to be adjusted in position through the upward and downward movements thereof, and on the other hand, the striker 19 has a second position control hole 19*a* and a plurality of bolt holes 19*b* formed at the inside thereof correspondingly to the first position control hole 18*a* and the plurality of bolt holes 18*b* formed on the accommodating portion 18 in such a manner as to be fixed to the accommodating portion 18 through the adjustment of the height of the striker 19 and a roller 19*c* coupled to the top portion of the front surface thereof by means of a shaft in such a manner as to allow the lock 2 of the door lock device 1 fixed to the door panel to be fixed at the inside thereof to maintain the locking state of the door.

The releasing means 20, which is disposed on the inside of the side panel of the refrigerator and freezer in such a manner as to allow the striker 19 of the housing 15 to be separated from the lock 2 of the door lock device 1, includes: the fixing frame 21 coupled to the base frame 11 by means of bolts in such a manner as to allow the slide recess 12 of the base frame 11 to be closed and having hinge lower peripheral surface seating portions 21*a* formed on the rear portion thereof in such a manner as to support the lower peripheral surface of the hinge shaft H thereagainst and to prevent the hinge shaft H from being exposed to the outside, a cam hole 21*b* formed on the inside thereof in such a manner as to pass the lower end periphery of the rotary cam 22 therethrough; the rotary cam 22 having a semicircular rotary protrusion 23 protruding from the top end periphery thereof in such a manner as to be brought into close contact with the top portion of the fixing frame 21 and the fitting protrusion 23*a* formed at the center of the top portion of the rotary protrusion 23 in such a manner as to be coupled to the fitting groove 12*b* of the base frame 11 to rotate the rotary cam 22; and the locking member 24 having a pushing inducing hole 24*a* formed at the inside thereof in such a manner as to be brought into close contact with the outer peripheral surface of the rotary protrusion 23 at the state of being seated into the slide recess 12 of the base frame 11 to maintain the fixed state of the locking member 24, so that if the rotary protrusion 23 rotates, the end portion of the rotary protrusion 23 pushes the rear surface of the pushing inducing hole 24*a* in such a manner as to allow the locking member 24 to be linearly reciprocated, and a locking protrusion 24*b* protruding from the front portion thereof in such a manner as to be inserted into the locking groove 17*a* of the locking flange 17 to maintain the rigidly fixed state between the base frame 11 and the housing 15.

On the other hand, the releasing means 20 has the inner handle 25 and the rotary shaft 26 disposed on the inside of the side panel to which the catcher 10 is fixed, and the end portion of the rotary shaft 26 is fitting-coupled to the inside of the rotary cam 22, so that if the inner handle 25 rotates when a person is locked in the interior of the refrigerator and freezer, the rotary shaft 26 and the rotary cam 22 rotate to allow the rotary protrusion 23 to move the pushing inducing hole 24*a* backward, and accordingly, the locking protrusion 24*b* of the locking member 24 is separated from the locking groove 17*a* to allow the housing 15 to rotate around the hinge shaft H. At this time, the roller 19*c* of the striker 19 coupled to the housing 15 is separated from the lock 2 of the door lock device 1, thus opening the door.

So as to allow the housing 15 to rapidly rotate under the condition where the housing 15 rotates to the rear portion of the base frame 11 around the hinge shaft H, the catcher release device according to the present invention further includes a first elastic member 30 having a pushing post 31 protruding from the interior of the housing 15, a pushing protrusion 32 protruding from the underside of the pushing post 31 and elastic rubber 33 disposed on the top end portion of the base frame 11 with which the pushing protrusion 32 is contacted, so that when the locking protrusion 24*b* of the locking member 24 is separated from the locking groove 17*a*, the pushing protrusion 32 pressing the elastic rubber 33 at the same time springs out by means of the elastic force of the elastic rubber 33, thus allowing the housing 15 to more rapidly rotate to open the door.

So as to strengthen the elastic force of the elastic member 30, moreover, the catcher release device according to the present invention further includes a second elastic member 34 having spring grooves 35 formed on the inside of both sides of the pushing post 31 and elastic springs 36 mounted in the spring grooves 35, so that through the elastic forces of the elastic springs 36, the housing 15 more rapidly rotates to open the door.

Under the above-mentioned configuration, an operation of the catcher release device for the refrigerator and the freezer according to the present invention will be explained below.

The refrigerator and freezer is used to keep articles to be cooled and frozen therein temporarily or for a long period of time and to prevent them from being decayed, and generally, if a handle (not shown) disposed on the door lock device 1 pulls to open the door of the refrigerator and freezer, the lock 2 moves backward together with the handle and is then separated from the striker 19 of the catcher 10, thus allowing the door to be open. The catcher 10 according to the present invention can be applied to both of a door lock device having separate releasing means with which the locking state is released when a person is locked in the refrigerator and freezer and a general door lock device with no separate releasing means. If a person is locked in the refrigerator and freezer, the inner handle 25 disposed on the side panel just rotates, and thus, the rotary shaft 26 and the rotary cam 22 rotate to allow the rotary protrusion 23 of the rotary cam 22 to move the pushing inducing hole 24*a* backward, so that the locking protrusion 24*b* of the locking member 24 is separated from the locking groove 17*a* to allow the housing 15 to rotate backward around the hinge shaft H, and thus, the roller 19*c* of the striker 19 is separated from the lock 2 of the door lock device 1, thus opening the door rapidly and easily.

The housing 15 rotates more rapidly by means of the elastic force of the first elastic member 30 in the process of rotating around the hinge shaft H, and the second elastic member 34 is additionally disposed in the housing 15 in accordance with the operating conditions or sites, thus opening the door more rapidly.

If the opening of the door is completed through the separation of the housing 15 from the base frame 11, the inner handle 25 returns to its original position by means of the elastic forces of the springs S elastically supporting the rear portion of the locking member 24 thereagainst, and the locking protrusion 24*b* of the locking member 24 is maintained at the protruding state from the front surface of the base frame 11. So as to maintain the door at the locking state again, the inner handle 25 rotates to maintain the backward moving state of the locking protrusion 24*b* of the locking member 24, and next, the housing 15 rotates to its original position. After that, if the inner handle 25 is free from a user's hand, the locking member 24 moves forward by means of the elastic forces of the springs S to allow the locking protrusion 24*b* to be inserted into the locking groove 17*a* of the locking flange 17, thus maintaining the locking state of the door.

As described above, the catcher release device for a refrigerator and freezer according to the present invention can operate if a person is locked in the refrigerator and freezer, without having any releasing means connected to the door lock device, thus rapidly opening the door for the refrigerator and freezer.

Additionally, the catcher release device for a refrigerator and freezer according to the present invention can provide an improved structure of the catcher in such a manner as to be applied to both of the door lock device having separate releasing means coupled thereto and the general door lock device with no separate releasing means, thus reducing the cost of the product, expanding the available range of the catcher, and improving the productivity thereof.

Further, the catcher release device for a refrigerator and freezer according to the present invention can have a coupling structure of the housing of the catcher wherein the base frame fixed by means of bolts to the side panel of the door of the refrigerator and freezer is forcibly not separated from the outside, thus improving the outer appearance of the housing, and that has the inner handle and the rotary shaft disposed on the inside of the side panel in such a manner as to be connected to the base frame, while the base frame and the housing are being coupled to each other by means of the hinge shaft, so that if the inner handle and the rotary shaft rotate, the rotary cam disposed between the base frame and the fixing frame rotates to allow the locking member to move backward to rotate the housing fixed to the base frame backward around the hinge shaft, and next, the striker is separated from the lock of the door lock device, thus rapidly opening the door.

Furthermore, the catcher release device for a refrigerator and freezer according to the present invention can have the elastic member disposed on the interior of the housing and the top portion of the base frame to allow the housing fixed to the base frame to rapidly rotate around the hinge shaft by means of the elastic force of the elastic member upon the opening of the door.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A catcher release device for a refrigerator or freezer, the catcher release device comprising:

a catcher having a base frame fixed to a side panel corresponding to a door of the refrigerator or freezer by means of bolts, a housing adapted to surround an interior of the base frame in such a manner as to prevent the base frame from being forcibly disassembled from the side panel, and the housing is fittingly coupled to the base frame by means of a hinge shaft in such a manner so as to allow the housing to rotate backward around the hinge shaft, and a striker fixed to a front surface of the housing by means of bolts in such a manner so as to locate the striker such that the striker cooperates with a lock of a door lock device attached to the door; and releasing means having a fixing frame coupled to an underside surface of the base frame by means of bolts in such a manner so as to support a lower end periphery of the hinge shaft thereagainst, a locking member and a rotary cam disposed, at least partially, between the fixing frame and the base frame in such a manner so as to allow one end of the locking member to extend into and retract out of engagement with an inside of the housing through rotation of the rotary cam so as to selectively fix the housing to the base frame, and an inner handle and a rotary shaft disposed on an inside of the side panel in such a manner so as to be coupled to a lower end periphery of the rotary cam, wherein rotation of the inner handle and rotary shaft rotates the rotary cam such that the locking member moves backward out of engagement with the inside of the housing so as to cause the housing to be unfastened from the base frame and allow the housing to rotate backward around the hinge shaft so that the striker is separated from the lock of the door lock device, thereby allowing the door to be opened by a person locked in the refrigerator or freezer.

2. The catcher release device according to claim 1, wherein the base frame includes fixing holes formed on top portions of side surfaces thereof in such a manner such that the base frame is fixed to the side panel by means of the bolts, a slide recess formed on a lower end portion thereof in such a manner so as to allow the locking member to extend from and retract into the slide recess and into and out of engagement with the inside of the housing, spring seating grooves formed on sides of a rear portion of the slide recess in such a manner so as to mount springs adapted to elastically support a rear surface of the locking member, a fitting groove formed at an inside of the slide recess in such a manner so as to fit a top end periphery of the rotary cam thereto, hinge top end peripheral seating portions formed at the rear portion of the slide recess in such a manner so as to support a top end periphery of the hinge shaft thereagainst, and a seating portion formed on a front portion thereof in such a manner so as to allow one end of the housing to be brought into close contact therewith.

3. The catcher release device according to claim 2, wherein the housing includes a rotary frame protruding from a rear surface of the inside thereof in such a manner so as to be coupled to the base frame by the hinge shaft, wherein the one end of the housing comprises a locking flange protruding downward from a front portion thereof in such a manner so as to be brought into close contact with the seating portion of the base frame, the housing further includes a locking groove forming the inside of the housing into and out of which the locking member engages, the locking groove is formed on an inside of a rear surface of the locking flange, and an accommodating portion is formed on an inside of the front surface of the housing in such a manner so as to couple the striker thereto, the accommodating portion having a first position control hole and a plurality of bolt holes formed at an inside thereof in such a manner so as to allow the position of the striker, coupled thereto, to be adjusted through the upward and downward movements of striker, wherein the striker has a second position control hole and a plurality of bolt holes formed at an inside thereof in such a manner so as to be fixed to the first position control hole and the plurality of bolt holes of the accommodating portion by means of bolts, and wherein the striker includes a roller coupled to a top portion of a front surface thereof.

4. The catcher release device according to claim 1, wherein the fixing frame is fixed to the base frame by means of bolts in such a manner so as to allow the slide recess of the base frame to be closed by the fixing frame, and wherein the fixing frame has hinge lower peripheral surface seating portions formed on a rear portion thereof in such a manner so as to support the lower end periphery of the hinge shaft thereagainst, and a cam hole formed on an inside thereof in such a manner so as to allow the lower end periphery of the rotary cam to protrude therefrom.

5. The catcher release device according to claim 1, wherein the rotary cam has a semicircular rotary protrusion protruding from a top end periphery thereof in such a manner so as to be brought into close contact with a top portion of the fixing frame, and a fitting protrusion formed at a center of a top portion of the rotary protrusion in such a manner so as to be rotatably coupled to a fitting groove of the base frame, wherein the inside of the housing into and out which the locking member engages is formed by a locking groove in a locking flange of the housing, wherein the locking member has a pushing inducing hole formed therein to receive the rotary protrusion of the rotary cam, and a locking protrusion protruding from a front portion thereof in such a manner so as to protrude forward from the slide recess of the base frame into and out of engagement with the locking groove of the locking flange of the housing.

6. The catcher release device according to claim 1, wherein shapes of the inner handle and the rotary shaft and a shape of an internal hole of the rotary cam are generally square.

7. The catcher release device according to claim 1, further comprising a first elastic member disposed between a pushing post, protruding from the interior of the housing, and the base frame, the pushing post protruding from a lower end portion of the housing toward a top end portion of the base frame.

8. The catcher release device according to claim 7, wherein the first elastic member comprises an elastic rubber disposed on the top end portion of the base frame corresponding to a pushing protrusion protruding from an underside of the pushing post such that when the locking member is retracted from engagement with the inside of the housing, the housing is allowed to rotate backward around the hinge shaft under the influence of an elastic force of the elastic rubber so as to be separated from the base frame.

9. The catcher release device according to claim 7, further comprising a second elastic member having spring grooves formed on an inside of sides of the pushing post, and elastic springs mounted in the spring grooves, one end of each elastic spring being brought into close contact with the corresponding spring groove and another end of each elastic spring being elastically brought into close contact with the base frame.

* * * * *